US005173091A

United States Patent [19]

Marek

[11] Patent Number: 5,173,091

[45] Date of Patent: Dec. 22, 1992

[54] CHEMICALLY BONDED ADHERENT COATING FOR ABRASIVE COMPACTS AND METHOD FOR MAKING SAME

[75] Inventor: Henry S. Marek, Worthington, Ohio

[73] Assignee: General Electric Company, Worthington, Ohio

[21] Appl. No.: 710,725

[22] Filed: Jun. 4, 1991

[51] Int. Cl.[5] ..... B24B 1/00

[52] U.S. Cl. ..... 51/295; 51/293; 51/296; 51/309

[58] Field of Search ..... 51/293, 295, 296, 309

[56] References Cited

U.S. PATENT DOCUMENTS

| | | | |
|---|---|---|---|
| 3,136,615 | 6/1964 | Bovenkerk et al. | 51/309 |
| 3,650,714 | 3/1972 | Farkas | 51/309 |
| 3,929,432 | 12/1975 | Caveney | 51/295 |
| 3,957,461 | 5/1976 | Lindstrom et al. | 51/295 |
| 4,156,329 | 5/1979 | Daniels et al. | 51/295 |
| 4,215,999 | 8/1980 | Phaal | 51/295 |
| 4,242,106 | 12/1980 | Morelock | 51/295 |
| 4,247,304 | 1/1981 | Morelock | 51/295 |
| 4,268,276 | 5/1981 | Bovenkerk | 51/295 |
| 4,399,167 | 8/1983 | Pipkin | 51/295 |
| 4,539,018 | 9/1985 | Whanger et al. | 51/309 |
| 4,666,466 | 5/1987 | Wilson | 51/295 |
| 5,062,865 | 11/1991 | Chen et al. | 51/295 |

*Primary Examiner*—William R. Dixon, Jr.
*Assistant Examiner*—Willie J. Thompson
*Attorney, Agent, or Firm*—Millen, White, Zelano and Branigan

[57] ABSTRACT

A method for coating cluster compacts of polycrystalline diamond and CBN particles is provided, wherein the cluster compact is not exposed to high temperatures due to selective heating of the coating/cluster compact interface with the use of laser energy. Strong coatings can be formed on thermally sensitive compacts which allow such compacts to be brazed directly to a tool holder.

18 Claims, No Drawings

CHEMICALLY BONDED ADHERENT COATING FOR ABRASIVE COMPACTS AND METHOD FOR MAKING SAME

BACKGROUND OF THE INVENTION

The present invention relates to polycrystalline masses of self-bonded diamond or cubic boron nitride particles useful as tool components and, more particularly, to a metal-coated compact of polycrystalline diamond (PCD) or cubic boron nitride (CBN) that contains a second phase which can be bonded directly to a tool holder without the need for a cemented carbide support.

Diamond and the cubic form of boron nitride find use as abrasive materials in the form of (a) aggregated particles bonded by a resin or metal matrix, (b) cluster compacts, and (c) composite compacts. As bonded aggregates, particles of CBN or diamond abrasive are embedded in a grinding or cutting section of a tool such as a grinding wheel. The particles are typically coated with various metals and alloys of metals to enhance bond retention, oxidation resistance, graphitization resistance, and similar benefits. Representative art in the coating of single grains includes U.S. Pat. Nos. 2,367,404; 3,650,714; 3,957,461; 3,929,432; and 3,984,214.

A cluster compact is defined as a cluster of diamond or CBN crystals bound together in (a) a self-bonded relationship, (b) by means of a chemically bonded sintering aid or bonding medium, or (c) some combination of the two. U.S. Pat. Nos. 3,136,615 and 3,233,908 provide a detailed description of CBN cluster compacts which utilize a bonding medium and methods for making the same. U.S. Pat. No. 3,233,908 also describes self-bonded CBN compacts.

The diamond or cubic boron nitride of the cluster compact can be formed by converting graphite or HBN while simultaneously bonding the crystals formed. Therefore, cluster compacts can be made by (a) a one-step process in which a catalyst metal or alloy aids in the transition to an abrasive particle simultaneously with the formation of the compact, (b) a one-step process in which the abrasive particle is converted directly into a compact without the aid of a catalyst or bonding medium, or (c) a two-step process wherein the particles are formed first and subsequently bonded, with or without a catalyst, sintering aid, or bonding medium, to form a cluster compact.

Cluster compacts which contain residual metal from a catalyst, metal bonding medium, or sintering aid as a second phase are thermally sensitive and will experience thermal degradation at elevated temperatures. Cluster compacts which contain self-bonded particles, with substantially no secondary non-abrasive phase, are thermally stable. Their thermal stability enables such cluster compacts to be bonded directly to a tool holder by bonding methods such as brazing.

Cluster compacts which contain less than 3% non-diamond/non-CBN phase are described in U.S. Pat. Nos. 4,224,380 and 4,228,248. The compacts described in these patents are referred to as "porous compacts". Such compacts have pores dispersed there through in about 5–30% vol % of the compact. The porous compacts are made thermally stable by removal of the metallic phase by liquid zinc extraction, electrolytic depleting, or a similar process. These thermally stable porous composites have substantially no residual metal phase to catalyze back conversion or expand at a different rate from the surrounding abrasive. Because of the rough surfaces of these porous composite compacts, retention to a tool holder by a physical bond is suitable, and conventional brazing techniques can be used. These compacts have been coated so as to improve their oxidative stability when being bonded to a tool holder.

Cluster compacts which contain residual metal for a catalyst, metal bonding medium, or sintering aid as a second phase have been used effectively when part of a composite compact. A composite compact is defined as a cluster compact bonded to a substrate material such as cemented tungsten carbide. The bond to the substrate is formed under high pressure, high temperature conditions either during or subsequent to the formation of the cluster compact. Detailed disclosures of certain types of composite compacts and methods for making the same are found in U.S. Pat. Nos. Re. 32,380; 3,743,489; 3,767,371; and 3,918,219. The cemented substrate allows the composite compacts to be bonded to a tool holder by brazing or other conventional bonding methods. When part of a composite, a thermally sensitive cluster compact can, therefore, be bonded to a tool holder without damage.

The cemented tungsten carbide substrate of the composite is substantially larger in size than the abrasive bonded thereto. Therefore, a significant portion of the mass charged in the high pressure, high temperature apparatus is the substrate material, either before formation of the cluster compact or after. This volume of substrate reduces the amount of material which can be charged in the reactor to form the abrasive.

It is desirable to provide a method which allows cluster compacts with a metallic phase to be bonded to a tool holder without the need for a cemented tungsten carbide substrate.

SUMMARY OF THE INVENTION

An object of this invention is to provide a strong, chemically bonded coating to thermally sensitive cluster compacts of diamond or cubic boron nitride particles without damaging the compact.

Another object of the present invention is to provide a cluster compact of diamond or cubic boron nitride particles with a metallic phase that is thermally sensitive which can be bonded to a tool by methods such as brazing without the need for a cemented carbide support bonded to the compact.

Another object of the present invention is to provide a simplified method for bonding thermally sensitive cluster compacts to a tool holder without a cemented carbide support for the cluster compact.

A further object of the present invention is to provide a method for coating compacts of diamond or CBN particles with a strong, chemically bonded coating by selectively heating the coating and the coating-particle interface.

Upon further study of the specification and appended claims, further objects and advantages of this invention will become apparent to those skilled in the art.

The present invention achieves these objects by providing a tool component comprising a coated cluster compact of polycrystalline diamond or cubic boron nitride particles having a metallic phase wherein the coating is chemically bonded to the compact. The shear strength of the bond between the coating and the compact is greater than 10,000 psi and is preferably greater in strength than the fracture strength of the particles in the cluster compact and greater than the strength of the braze by which the tool component is bonded to a tool body.

These coated cluster compacts can be obtained by depositing on a cluster compact a layer of coating material that is reactive with the polycrystalline particles therein and subsequently radiating this layer of coating material with laser energy so as to heat, the layer of coating material and the polycrystalline particles at the coating-particle interface sufficient to chemically bond the layer of coating material to the particles.

DETAILED DESCRIPTION OF THE PREFERRED EMBODIMENTS

This invention provides tool compacts which incorporate a cluster compact of an abrasive having a metallic phase, typically as a residue. The metal of this metallic phase is present in an amount which renders the compact thermally sensitive, which can be below 0.05 vol %. The amount of metal preferably ranges from 0.05 to 50 vol % of the compact. A thermally sensitive cluster compact is defined herein as one which experiences cracking at temperatures of about 700° C. and above. Compacts with a metallic phase are conventional and are typically bonded to a cemented carbide substrate. These compacts are unstable at high temperatures because the metallic phase can cause differential expansion or back conversion of the abrasive. The metallic phase present in cluster compacts is typically derived from sintering aids, bonding media, and/or conversion catalysts used in forming the compact.

The cluster compacts used in the tool components of the present invention comprise polycrystalline diamond or CBN particles as the abrasive phase. These cluster compacts can be obtained by conventional high pressure/high temperature techniques. This includes (a) one-step techniques for converting a source of carbon or boron nitride, such as graphite or hexagonal boron nitride (HBN), directly into a cluster compact of diamond or cubic boron nitride (CBN) with the aid of a catalyst, and (b) two-step procedures, wherein graphite or HBN is first converted to diamond or CBN particles, respectively, with or without a catalyst, and the resultant particles are bonded in a cluster compact with a bonding agent, sintering aid, or residual conversion catalyst present.

U.S. Pat. Nos. 3,233,988 and 3,918,219 describe examples of suitable CBN cluster compacts and methods for obtaining them by converting HBN particles directly to a cluster compact of CBN particles under high pressures and temperatures with the aid of a magnesium or aluminum catalyst, respectively. Other catalysts which will provide suitable cluster compacts include those selected from the class consisting of alkaline metals, alkaline earth metals, tin, lead, antimony, aluminum, and alloys of cobalt, nickel, and manganese.

U.S. Pat. Nos. 3,136,615 and 3,233,988 describe examples of suitable CBN and diamond cluster compacts and methods for their production formed with the aid of a bonding medium or sintering aid. Suitable bonding media for CBN include boron carbide. Suitable sintering aids include $Al_2O_3$, W, Cr, Mn, Co, Mo, Ti, Ni, Cu, Re, Zr, BeO, and Be.

Included within the suitable cluster compacts used in the tool components of this invention are the porous polycrystalline diamond and CBN compacts produced with a sintering aid which have not been treated to remove the infiltrated metallic phase. Such porous compacts are intermediates in the procedures described in U.S. Pat. Nos. 4,224,380 and 4,288,248. The abrasive in these porous compacts comprises about 70 to 95 vol % of the compact which is bonded to form a network of interconnected empty pores. The metallic phase of sintering aid material within the porous compacts ranges from 0.05–3 vol %. For porous compacts, suitable sintering materials include those catalysts described in U.S. Pat. Nos. 2,947,609 and 2,947,610, such as Group IIIA metals, Cr, Mn, and Ta. These porous compacts are not thermally stable unless the second phase is removed, as taught in U.S. Pat. Nos. 4,224,380 and 4,288,248.

Although not preferred, composite compacts of a diamond or CBN cluster compact supported on a substrate are suitable for use in the tool components of the present invention. The diamond or CBN abrasive in these composite compacts have a metallic phase, a portion of which is derived from the supporting substrate that migrates into the abrasive. Examples of suitable CBN composite compacts and methods for their production are described in U.S. Pat. Nos. 3,743,489; 3,767,371; and 3,918,219. Examples of suitable diamond composite compacts and methods for their production are described in U.S. Pat. Nos. Re. 32,380; 3,745,623; and 3,609,818.

All processes for preparing the cluster compacts used in this invention require high pressure/high temperature apparatus such as is disclosed in U.S. Pat. No. 2,941,248. These devices are typically capable of providing pressures in excess of 100 kilobars and temperatures in excess of 2000° C. Significant components of the device include a pair of cemented tungsten carbide punches and a die member of the same material which can withstand extreme pressures and temperatures. Cobalt-cemented carbide grade 55 is another material suitable for the punches and die member which is capable of sustaining pressures in the range of 100–200 kilobars without fracture. A pair of insulating members are typically positioned between the punches and die, and the die member typically has an aperture to receive a reaction vessel.

The reaction vessel comprises a material, such as a salt, which is not converted to a stronger, stiffer state under high pressure, high temperature conditions and has no volume discontinuities. Within the reaction vessel is an electric resistance heater, typically of graphite, that is lined with insulating members, typically comprised of a salt. Further details concerning the components of a high pressure, high temperature apparatus can be found in U.S. Pat. No. 2,941,248, which describes but a few of the configurations capable of providing the pressures and temperatures required to form the cluster compacts used in this invention.

The reaction conditions used to form the cluster compacts and the duration of reaction can vary widely with the composition of the starting materials, i.e., graphite or HBN, and the desired end product. Temperatures and pressures of from 1000°–2000° C. and pressures of from 50 to 95 kilobars are typical. The actual conditions are dictated by pressure-temperature phase diagrams for carbon and boron-nitride, as described in U.S. Pat. Nos. 4,188,194; 3,212,852; and 2,947,617.

The cluster compacts incorporated in the tool components of this invention are preferably used as formed within the high pressure, high temperature apparatus. However, the cluster compacts used may be cut from larger masses if desired. The size and shape of the tool components are limited only by the size and shape of the cluster compacts.

The materials that form the metallic phase can vary widely. Any metal or ceramic thereof can form the metallic phase. Such materials typically include metals recognized as catalysts for converting graphite or HBN particles into a stronger, more compact state or for forming compact masses thereof; and, in addition, they include ceramics of such metals such as the carbides and nitrides of titanium, tantalum, molybdenum, zirconium, vanadium, chromium, and niobium. The metals within these ceramics are believed to be isolated at high temperatures and cause instability. Alloys of these metals with other catalyst metals and non-catalyst metals may also form the metallic phase. The cluster compact used to provide the tool component of this invention may have more than one metal and, therefore, more than one metallic phase. Reference made herein to a cluster compact with a metallic phase is intended to also include those cluster compacts with more than one metal.

As discussed below, the amount of material which forms the metallic phase can vary widely and is typically in the range of 0.05 to 50 vol % of the compact and, more typically, less than 25 vol %. In preferred embodiments, the cluster compact comprises polycrystalline abrasive particles in excess of 70 vol % of the composite. The upper limit for the volume of metallic phase is defined by the performance and effectiveness of the tool component as the abrasive phase is diluted. The presence of any metallic phase is expected to cause some instability at temperatures greater than 700° C. For example, less than 0.05 vol % of metallic phase will cause instability. Testing a cluster compact for thermal stability is an accurate means for determining the presence of a metallic phase.

In the tool components of this invention, the cluster compact has a coating chemically bonded thereto. The bond between the coating and the particles of the cluster compact has a shear strength greater than 10,000 psi and is preferably greater than the fracture strength of the particles in the cluster compact and greater than the strength of the braze by which the tool component is bonded to a tool body. The bond strength required will depend on the tool in which the components are to be used. For some applications, a bond with a shear strength of 30,000 psi is desired. To obtain such a bond, the coating is reacted with the surface particles of the cluster compact. Strong bonds to diamond compacts can be obtained from coating materials which are carbide formers. Strong bonds to CBN compacts are obtained from coating materials which form borides or nitrides. Ceramics that form mixed phases are also suitable. Metals and ceramics thereof which are conversion catalysts, bonding media, or sintering aids for the respective compacts are typically suitable. Examples of suitable metals for coating cubic boron nitride cluster compacts include tin, lead, antimony, or nitrides thereof; cobalt; tungsten; titanium; zirconium; hafnium; vanadium; niobium; tantalum: chromium; molybdenum; nickel; tungsten; or a carbide, boride, nitride, or oxide thereof. For diamond cluster compacts, the coating can comprise boron, aluminum, nickel, copper tungsten, titanium, iron, cobalt, chromium, manganese, tantalum, or an alloy with or without a non-catalytic metal or a carbide, boride, nitride, or oxide thereof.

The coating may comprise multiple layers applied successively, provided the coated compact exhibits the necessary bonding strength when installed on a tool body.

The thickness of the coating material is selected so as to form strong bond with the tool body, such as by brazing, and preferably ranges from 1-50 μm. This bond must also have a shear strength in excess of 10,000 psi.

The coating must be applied and reacted with the composite surface without exposing the compact body to temperatures beyond which it remains stable, typically in excess of 700° C. This is accomplished by heating the coated compact with a laser according to the process of this invention described more particularly below. By utilizing this method, the tool components of the present invention are coated with no crack formation within the composite.

Not all surfaces of the composite need be coated. Only that portion to be bonded to the tool body need have a coating with a high strength bond. In addition, the bond strength of the coating may vary across the surfaces of the composite. For example, the composite may be uniformly coated with tungsten, but only one surface need have high bond strength due to selective exposure to laser energy by the process of this invention. The bond strength of the coating may also vary across the surface, as well, by exposing the coated compact to laser energy in a selected pattern.

The method of this invention provides strongly adherent coatings to cluster compacts of polycrystalline diamond and CBN particles with minimal exposure of the cluster compact to high temperatures. The method of this invention is suitable for use with any cluster compact, including the thermally stable compacts described in U.S. Pat. Nos. 3,233,988; 4,288,248; and 4,224,380; and thermally sensitive compacts with a metallic phase as described above.

In this process, a layer of coating material is deposited on a cluster compact of polycrystalline diamond particles or cubic boron nitride particles, preferably at a temperature below 700° C. for thermally sensitive compacts and most preferably below 600° C. All or a portion of the compact may be coated. The coating material used with diamond compacts must be a carbide former and the coating material used with CBN must be a boride or nitride former. Suitable coating materials include metals, alloys, and ceramics. Specific materials that are suitable are described above with respect to tool components of this invention. Of importance in forming tool components is that the surface of the cluster compact be coated with sufficient material to provide an adequate bond to said tool holder with a shear strength of greater than 10,000 psi, preferably greater than 30,000 psi. Layers of from 1-50 μm in thickness are suitable, and layers of about 10 m are preferred. Multiple metal layers can be applied, as well as alloys thereof.

The layer of coating material may be applied by any one of a variety of techniques. These include, for example, pyrolytic plating, metal abrasion, sputtering, reactive sputtering, chemical vapor deposition, plasma coating, or the like. A physical bond between the layer of coating material and the cluster compact that prevents losses during handling is all that is necessary. The layer of coating material must be uniform to the extent that variations in thickness are less than 25% of the total thickness. The preferred method for depositing the layer is chemical vapor deposition in that it provides uniform thickness and very good adherence to the composite. Temperatures below 700/C. can be used in CVD processes when applying certain coatings. For example, tungsten is deposited by CVD methods at temperatures of about 600° C. by reaction of $WF_6$ and $H_2$. Electrolytically deposited metal overcoats of the CVD coat may be advantageous in that thicker films can be obtained more efficiently.

Following deposition of a layer of the coating material on the cluster compact, the material is radiated with laser energy so as to selectively heat the layer and particles at the coating-particle interface to a temperature sufficient to react. The layer of coating material and the particles at the interface are preferably selectively heated to temperatures in excess of 700° C. and most preferably 800°-900° C. by the laser beam. The selective heating by the laser beam will provide chemical reaction between the surface particles of the cluster compact and coating without raising the temperature of the composite compact body significantly. This will avoid the formation of cracks where the compact contains a metallic phase and is thermally sensitive. High surface temperatures can be tolerated in that heat is easily dissipated through the compact body because of the high thermal conductivity of diamond and the significant difference in thermal conductivity of tungsten and diamond. Patterns can also be generated in the surface of the coating so as to provide differentiated regions of high bond strength and avoid the formation of cracks in the cluster compacts.

To control the high surface temperatures obtained, the intensity of the laser beam, and the scanning rate can be varied. The intensity can be varied by focusing the beam or modifying the output of the laser. Preferably, the layer of coating material is exposed to short pulses of high intensity laser energy. The compact is preferably in a hydrogen atmosphere or under vacuum when exposed to the laser radiation. Following exposure to laser energy, the coated composite is cooled and can be installed in a tool body by applying a brazing alloy to the chemically bonded coating. This can be performed by conventional brazing techniques as are utilized with thermally stable compacts.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the foregoing and in the following examples, all temperatures are set forth uncorrected in degrees Celsius; and, unless otherwise indicated, all parts and percentages are by weight.

The entire disclosures of all applications, patents, and publications, cited above and below, are hereby incorporated by reference.

EXAMPLES

Cluster compacts of polycrystalline diamond particles produced by the methods of U.S. Pat. Nos. 4,224,380; 3,136,615; and 3,233,988 are selected for coating. Compacts to be evaluated are about 1 gm to total weight and about 1 $cm^2$ in size. A tungsten coating is applied to the compacts at a thickness in the range of about 4-10 μm utilizing $WF_6$ and $H_2$ by conventional chemical vapor deposition techniques. A temperature of about 550° C. is utilized. The tungsten is uniformly coated on the cluster compact. After removal of the compact from the chemical vapor deposition apparatus, the compact is placed in an evacuated chamber of a $CO_2$ or ND:YAG laser with a power output of at least 200 watts, preferably greater than 1000 watts. Most preferably the power output is sufficient to cut diamond and CBN compacts (1-25 kw). The power intensity of the beam and the cross sectional area of the beam are preferably adjusted to provide a power density of about $10^6$ watt/$cm^2$. At such a power density the tungsten layer exposed to the beam is heated to temperatures of about 900° C. in less than 1 second, most preferably microseconds. The beam can be scanned across the surface of the compact at about 1-30 inches per second where the beam has a cross sectional area of from 0.1 to 1.0 mm. Alternatively, the beam can be pulsed on and off over selected portions of the compact. The compact is removed from the chamber and brought to ambient conditions. When brazed to a straight bar under conventional brazing conditions using a conventional brazing alloy, the tool is successfully used to machine a Raney 41 alloy.

The preceding examples can be repeated with similar success by substituting the generically or specifically described reactants and/or operating conditions of the process and components of the apparatus of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A tool component comprising a cluster compact of polycrystalline diamond or cubic boron nitride having a metallic phase, wherein said cluster compact has a coating chemically bonded thereto-with a bond shear strength greater 10,000 psi.

2. A tool component as in claim 1, having a coating of sufficient thickness to be brazed in a tool body with a bond shear strength greater than 10,000 psi.

3. A tool component as in claim 2, wherein said cluster compact is unstable at temperatures in excess of 700° C., and the metallic phase is derived from a conversion catalyst, sintering aid, and/or bonding medium.

4. A tool component as in claim 3, wherein said cluster compact has a metallic phase in an amount of 0.05 to 50 vol %.

5. A tool component as in claim 4, wherein only a portion of the cluster compact has a coating chemically bonded thereto.

6. A tool component as in claim 5, wherein only a portion of the coating is chemically bonded to the cluster compact.

7. A tool component as in claim 3, wherein said coating has a thickness which ranges from 1 to 50 μm and is comprised of:

a. a metal selected from the group consisting of boron, aluminum, nickel, copper, tungsten, titanium, iron, cobalt, chromium, manganese, tantalum, or a nitride, carbide, boride, or oxide thereof where the cluster compact is comprised of polycrystalline diamond, or b. a metal selected from the group consisting of tin, lead, antimony or nitride thereof; cobalt, tungsten, titanium, tantalum, vanadium, niobium, hafnium, chromium, manganese, and nickel; or a carbide, nitride, boride, or oxide thereof where said cluster compact is comprised of polycrystalline cubic boron nitride.

8. A tool insert as in claim wherein the cluster compact forms part of a composite and is bound to a substrate.

9. A tool insert as in claim 1, wherein the cluster compact is porous, and the polycrystalline diamond or cubic boron nitride comprises 70–95% by weight of the compact by volume.

10. A tool insert comprising a polycrystalline diamond compact having 1 to 20 vol % of residual tungsten or tungsten carbide sintering aid that is coated with from 1–50 μm of a tungsten layer chemically bonded thereto with a bond shear strength greater than the fracture strength of the polycrystalline diamond.

11. A method for coating cluster compacts of polycrystalline cubic boron nitride or diamond which comprises depositing on said cluster compact a layer of a coating material which is reactive with the polycrystalline diamond or cubic boron nitride therein and radiating this layer of coating material with laser energy sufficient to heat the layer of coating material and the polycrystalline diamond or cubic boron nitride at the coating-cluster compact interface and form a chemical bond therebetween.

12. A method as in claim 11, wherein (a) the cluster compact has a metallic phase and is unstable at temperatures in excess of 700° C., (b) the layer of coating material is deposited at a temperature of less than 700° C., and (c) the layer of coating material and polycrystalline diamond or cubic boron nitride at the coating-cluster compact interface are heated to a temperature in excess of 700° C. with laser energy while maintaining a substantial portion of the polycrystalline diamond or cubic boron nitride in said cluster compact body at a temperature below 700° C.

13. A method as in claim 12, wherein the layer of coating material is applied at a temperature of from 300°–600° C. by chemical vapor deposition and is heated to a temperature of about 800° to b 900° C. with the polycrystalline diamond or cubic boron nitride at the coating-cluster compact interface with laser energy.

14. A method as in claim 13, wherein the layer of coating material has a thickness of 1–50 μm and is comprised a. a metal selected from the group consisting of boron, aluminum, nickel, copper, tungsten, titanium, iron, cobalt, chromium, manganese, tantalum, or a nitride, carbide, boride, or oxide thereof where the cluster compact is comprised of polycrystalline diamond, or b. a metal selected from the group consisting of tin, lead, antimony or nitride thereof; cobalt, tungsten, titanium, tantalum, vanadium, niobium, hafnium, chromium, manganese, and nickel; or a carbide, nitride, boride, or oxide thereof where said cluster compact is comprised of polycrystalline cubic boron nitride.

15. A method as in claim 14, wherein only a portion of the layer of coating material is exposed to laser energy.

16. A method as in claim 14, wherein only a portion of the cluster compact is coated with a layer of coating material.

17. A method as in claim 11, wherein the chemical bond between the polycrystalline diamond or cubic boron nitride to the layer of coating material is greater than the fracture strength of the polycrystalline diamond or cubic boron nitride in the cluster compact.

18. A method as in claim 14, wherein multiple layers of coating material are deposited on the cluster compact.

* * * * *